United States Patent [19]

Azzam

[11] 4,368,464

[45] Jan. 11, 1983

[54] EIGHT SEGMENT DISPLAY FOR ORIENTAL NUMERALS

[75] Inventor: Nadim Azzam, Neufahrn, Fed. Rep. of Germany

[73] Assignee: Eurosil GmbH, Munich, Fed. Rep. of Germany

[21] Appl. No.: 217,569

[22] Filed: Dec. 17, 1980

[30] Foreign Application Priority Data

Sep. 17, 1980 [DE] Fed. Rep. of Germany ..... 3034966

[51] Int. Cl.[3] ..... G09G 3/20

[52] U.S. Cl. ..... 340/756; 340/790

[58] Field of Search ..... 340/756, 790, 789, 378.2

[56] References Cited

U.S. PATENT DOCUMENTS

| | | | |
|---|---|---|---|
| 2,966,616 | 12/1960 | Mash | 340/756 |
| 2,977,415 | 3/1961 | Van Breeman | 340/756 |
| 3,827,043 | 7/1974 | Maezawa | 340/756 |
| 4,122,444 | 10/1978 | Kitajima et al. | 340/790 |
| 4,262,291 | 4/1981 | Zammit et al. | 340/790 |

*Primary Examiner*—Marshall M. Curtis

*Attorney, Agent, or Firm*—Scully, Scott, Murphy & Presser

[57] ABSTRACT

A numerical display arrangement with at least one display device for the selective representation of oriental numerals in the values of zero to nine from individual, and discretely controllable electro-optical display segments which are grouped within a parallogram-like frame upstanding on a narrow side thereof. The numerical display arrangement includes eight segments of which there are arranged along the upper narrow side of the frame from left to right, as viewed in the direction towards the display arrangement, two elongate segments adjacent each other and a point-shaped segment, therebelow along the left lengthier frame side two elongate segments below each other, along the right lengthier frame sides an elongate segment, between these along the narrow lower frame side there is a tied in segment and in the center region of the frame there is an elongate diagonal segment extending approximately from the right lower frame corner upwardly toward the left.

6 Claims, 3 Drawing Figures

| 18 D | C | B | A | | a | b | c | d | e | f | g | h 14 |
|---|---|---|---|---|---|---|---|---|---|---|---|---|
| 0 | 0 | 0 | L | 1 | ○ | ○ | ○ | ○ | ○ | ○ | ○ | ● |
| 0 | 0 | L | 0 | 2 | ○ | ○ | ○ | ○ | ○ | ○ | ● | ● |
| 0 | 0 | L | L | 3 | ● | ○ | ○ | ○ | ○ | ○ | ● | ● |
| 0 | L | 0 | 0 | 4 | ○ | ○ | ● | ● | ● | ● | ○ | ○ |
| 0 | L | 0 | L | 5 | ○ | ○ | ● | ● | ○ | ○ | ○ | ● |
| 0 | L | L | 0 | 6 | ○ | ○ | ○ | ○ | ● | ○ | ○ | ● |
| 0 | L | L | L | 7 | ○ | ● | ○ | ○ | ○ | ○ | ○ | ● |
| L | 0 | 0 | 0 | 8 | ○ | ○ | ○ | ● | ○ | ○ | ○ | ● 20 |
| L | 0 | 0 | L | 9 | ○ | ○ | ○ | ○ | ● | ● | ○ | ● |
| 0 | 0 | 0 | 0 | 0 | ○ | ○ | ● | ○ | ○ | ○ | ○ | ○ |

EIGHT SEGMENT DISPLAY FOR ORIENTAL NUMERALS

BACKGROUND OF THE INVENTION

1. Field of the Invention

The present invention relates to a numerical display arrangement with at least one display device for the selective representation of oriental numerals in the values of zero to nine from individual, discretely controllable electro-optical display segments which are grouped within a parallelogram-like frame upstanding on a narrow side thereof.

2. Discussion of the Prior Art

A numerical display arrangment of the above type has become known from German published patent application No. 26 06 946. The display is so designed as to selectively switchable over in one line of display devices or among each other on two lines of the display device the representation of numerals, particularly inputs and results in an electronic pocket calculator, in which the so-called arabic numerals especially as they have formed themselves in the Western cultural sphere, in essence, in that numeral representation as has been formed out from the Arabic-Persian cultural sphere (hereinafter referred to as "oriental numerals" for purposes of simplification).

The offering of arabic and oriental numerals adjacent to each other or being switchable over in the same line of display devices necessitates a complex matrix control circuit. The representation of the two types of numerals adjacent each other is effected for arabic numerals in the usual seven-segment representation, whereas for the oriental numerals it is necessary to use eleven segments for representation thereof. In the instance of the switchable numerical representation on a single display device, twelve segments are necessary. Even the eleven-segment representation of the oriental numerals, notwithstanding the high demand of discretely to be controlled segments is no longer sensible; particularly difficult becomes the recognition of arabic numerals in the twelve-segment device concurrently serving for the representation of oriental numerals. Notwithstanding the additional segments, even here the representability of oriental numerals leaves something to be desired, possibly due to the limitation to simple rod shaped (linear, bent and angled) segments.

The representation of oriental numerals pursuant to the Japanese Petty patent application No. 16,298/80 is in effect, adequate with ten of such rod-shaped elements (independently of the symbol for the numerical value "zero"); however, the sensibility of the offering of oriental numerals again leaves something to be desired in that, in the realization of these segment arrangements in small-surfaced display devices, in which the distinguishing criteria of the numerals with the above determined shaped elements is quite difficult to ascertain.

In German laid-open patent application No. 29 36 692 there is illustrated the offering of oriental numerals in a combination from only seven segments. Hereby there thusly reduces itself the control requirement for the offering of oriental numerals; but just for inexpensive mass-produced products which direct themselves to broad population circles, is that type of simplified representation of oriental numerals hardly usable, since the deviation from the usual writing required in that country is too extensive and the recognizability of the numerical representation on the display device, accordingly, requires an excessive degree of concentration.

In recognition of a practically unimproved approach to the actual mode in the writing of oriental numerals, the ten-segment device pursuant to German laid-open patent application No. 26 22 169 provides exclusively linear segments (independently of the numeral with the value "zero"). Added thereto is that, in this case there are provided two intersecting segments which, in the practical effectuation of the segment arrangement within a single plane, leads to the requirement for corresponding further subdivisions, in actuality to a twelve-segment arrangement, in order to avoid having to deal with reading difficulties and errors as a result a parallax appearances for depth-stepped segment formation.

SUMMARY OF THE INVENTION

The invention is, accordingly based on the recognition that in view of the two large markets which are quite clearly defined with respect to each other, in which, on the one hand, there is required the arabic numeral representation and, on the other hand, it is desirable to have an oriental numeral representation for the inclusion of wider consumer circles, it is no longer required to offer both numerical representations adjacent each other or switchable over within a single apparatus; whereas, on the other hand, the apparatus which is to be equipped with suitable display devices as such relative to its technical function up to the control of the display device should be constructed as such as unitarily as possible in the interest of inexpensive mass production, in effect, independently of the concretely required numerical representation. Within the scope of this recognition, the invention has as its object to so provide a numerical display arrangement of the above-mentioned constructional type so that for a low manufacturing requirement with regard to the recognizability of the segment representation, and for a low technical circuit requirement for the control, its display arrangement is universally applicable.

The foregoing object is inventively achieved in that the numerical display arrangement as set forth hereinabove includes eight segments of which these are arranged along the upper narrow side of the frame from left to right, as viewed in the direction towards the display arrangement, two elongate segments adjacent each other and a point-shaped segment, therebelow along the left lengthier frame side two elongate segments below each other, along the right lengthier frame sides an elongate segment, between these along the narrow lower frame side there is a tied in segment and in the center region of the frame there is an elongate diagonal segment extending approximately from the right lower frame corner upwardly towards the left.

Through these only eight segments there is obtained, even for a small-surfaced arrangement, an easily recognizable representation of oriental numerals at a control requirement which is not appreciable larger than that for the representation of the usual seven-segment arabic numerals. Hereby, the readily mutually distinguishable numerical representation is also given, particularly since (in contrast with the relationships pursuant to the German published patent application No. 26 06 946, or pursuant to German Laid-Open Patent Application 26 22 169) the individual numerical representation of different values appear essentially as characteristic groupings of short segments in relation to the lengthy diagonal segment; whereas, on the other hand, in relation to the given conditioning pursuant to the Japanese petty patent application No. 16.298/80, there is a saving of required segments at a still more improved numerical representation, particularly with the solution set forth hereinabove, in that there is opened up the more advantageous linkage, especially in the left half of the display arrangement. It is through the displacement of the left lower segment towards the center of the narrow side that the lower segment can be concurrently utilized for the representation of the numerical value "zero," and that for the last-mentioned state of the technology, in the left lower quadrant there is obviated the additionally required diagonal segment.

For the readily recognizability of the oriental numerical representation which is presently combined from these segments, there also aids that the individual segments grouped about the diagonal segment in alternating arrangement accordance with the oriental numerical representation, are to be currently controlled only once or twice for the different numerical representations, so that there obtained extremely different geometric patterns, and thereby the numerical representations, even for a small-surfaced construction, can be easily distinguished from each other; the only instance in which the segments which encompass the diagonal are to be controlled for three different oriental numerical representations is given just when the diagonal segment is not controlled, which again is a easily assumable differentiating criterium at the visual determination of the oriental numerical representation. The visual receipt of the numerical representation is further facilitated through the association of sicle-shaped and wedge-shaped or trough-shaped surface edges for the individual segments, which provides especially advantageous additional visual distinction criteria in the larger number of smaller segments located in the upper half of the dispaly arrangement. The sloped position of the right segment provides for the further advantage in that within the frame of the lower right corner thereof, there can also be located a decimal point.

It is advantageous that the control of the segments for the oriental numerical representation be given in such a manner that in the applicable binary coding which is usual for the Arabic numerical representation, the decimal value (BCD) remains usable. There must then be merely replaced the common "BCD-to seven-segment driver" by a "BCD-to eight-segment driver" with a gating circuit for converting the BCD information into the eight-segment control for the representation of oriental numerals. Hereby, it is then in each case advantageous that the display arrangement itself, which carries the eight-segment arrangement for the representation of an oriental numeral, be equipped with a driver containing one such gating circuit, when in the display segments it relates to such which, due to their control power requirement, necessitate a drive circuit which is not integratable in the calculator or control circuit. The mentioned gating circuit can, for example, be mounted rearwardly on the carrier material for the mounting and the electrical connection of the segments for each display arrangement (also for each numerical representation) mounted as an integrated circuit, or even, upon selection of a suitable carrier substrate, can be directly formed on the rearsurface in an integrated technology. This provides for each oriental numerical representation a display arrangement from the required display segments with the driver logic in the form of a gate circuit so that an electronic apparatus, such as for instance a counter, a calculator display or a watch, whose circuit function evidences standardized BCD outputs, can be selectively equipped with the usual combination of driver and display for the representation of Arabic numerals or with a display arrangement as set forth hereinabove for the current representation of an oriental numeral, in accordance in which cultural sphere there is the marketing area of the electronic apparatus. There need not be effected any modifications in the standard circuit of this apparatus itself.

BRIEF DESCRIPTION OF THE DRAWINGS

Further advantages and features of the invention can be ascertained from the following detailed description of preferred embodiments as shown schematically in the drawings restricted to the essential components, with respect to the individual segment construction being dimensionally approximately represented in the usual measure; in which the drawing illustrate.

DETAILED DESCRIPTION

Figure 1:
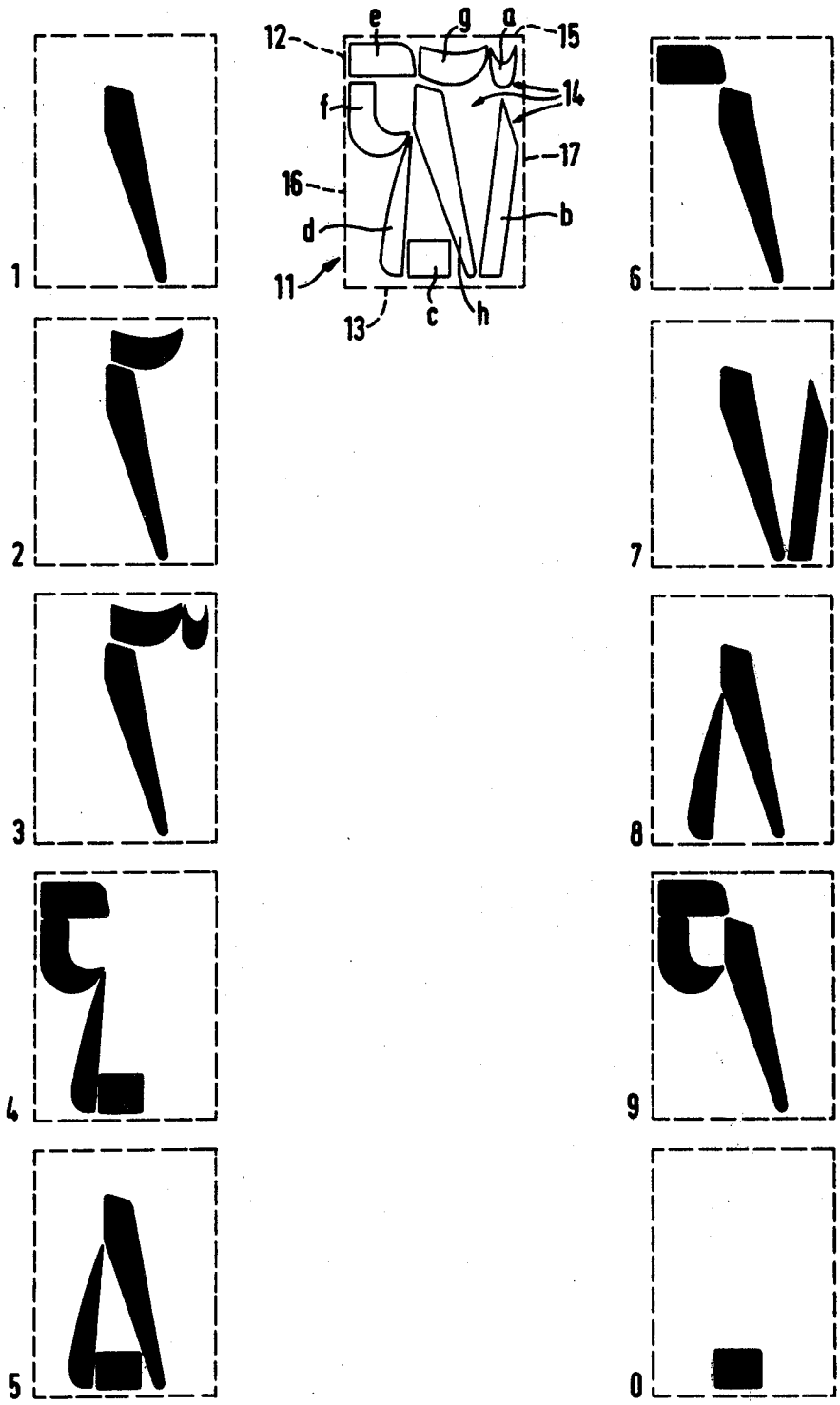
FIG. 1 shows in the upper center the position and preferred configuration of the segments within the display arrangement for the representation of an oriental numeral, as well as the left and right columns the numerical representations for the values one through nine and zero formed therefrom.

The display arrangement 11 shown in the upper center in FIG. 1 serves for the selective representation of an oriental numeral of different values in the decimal system. For the multiposition oriental numerical representation there are arranged a corresponding plurality of such display arrangements 11 in one row so as to be combined into a numerical display device. For the representation of oriental numerals of different decimal values, each display arrangement 11, as shown in FIG. 1 as a rectangle, parallelogram-like frame 12, which stands on its lower narrower side 13, evidences a definite arrangement of eight segments 14, namely a, ———h. The foregoing relates, for example, to an electro-optical projector such as correspondingly bordered or combined light diodes, luminescent elements or the like, however, preferably liquid crystal cells between a transparent forward electrode and a back electrode or counter electrode for the electrically controllable switching over of the optical properties of the liquid crystal material. Also when, for example, due to technological reasons, segments 14 which are larger than in FIG. 1 are subdivided over their surface but are electrically combined, within the scope of the foregoing description there is spoken of "one segment" 14; it is decisive that these segments 14 are selectively controllable so as to draw therefrom the different oriental numerical representations pursuant to the illustration in the left and in the right column of FIG. 1. Frame 12, which is illustrated in phantom in FIG. 1, within which there is present the defined arrangement of the segments 14, need no longer come into appearance in the display arrangment 11, and particularly in the grouping into multi-positional numerical representations.

Along the upper narrow side 15 of the frame 12 there are arranged or formed three segments 14, in essence, in viewing direction from left towards the right, of two elongate segments 14*e*, 14*g* and in the right upper corner of the frame 12 a point-shaped segment 14*a*. Thereby, the last-mentioned is bounded upwardly and downwardly in an extensively U-shaped bend, with the upwardly extending tips being of a type of the upwardly open transverse thereto moon arc. The upper middle segment 14*g* is similar to a sicle with a much smaller curvature and bordered with an also downwardly extending curve, whereby it extends towards the right upwardly adjacent, and left towards the here positioned tip of the segment 14*a*, and is bluntly edged as can be recognized in detail in FIG. 1.

Along the left lengthier side 16, below the upper left segment 14*e* which reaches up to the left lengthier side, there extends two elongate segments 14*f* and 14*d*, whereby the last-mentioned reaches down to the lower narrow side 13 of the frame 12. The upper left segment 14*f* extends L-shaped bent with a quarter circle-like sicle-shaped transition between the L-arm and pointedly extending from the left lengthier side 16 to the free end of the horizontal arm extending towards the frame center. The lower left segment 14*d* is bounded elongatedly drop-shaped or wedge-shaped and is displaced in parallel relative to the center of the lower narrow side 13 with respect to the left longitudinal side 16, whereby its pointedly angled upper end lies adjacent the tip of the L-shaped upper left segment 14*f*.

The right segment 14*b* is bounded similar to an elongate trapezoid and is so positioned under an acute angle opposite the right lengthier side 17 of the frame 12, so that its lower end is offset towards the center region of the lower narrow side 13, and in the center region of the right lengthier side there is given the closest approach of the segment 14*b* to the frame 12; from here on the segment 14*b* reduces itself upwardly in order to end in a tip below the middle of the U-sed upper right segment 14*a*.

The elongate diagonal 14*h* extends from the lower narrow side 13, at the left adjacent the lower end of the right segment 14*b*, through the center region of the frame 12 towards the region of the blunt contact between the two elongate upper segments 14*e*, 14*g*, passing in close proximity adjacent the mutually adjoining tips of the segments 14*f*, 14*d*. Hereby, the diagonal segments 14*h* is bounded in a wedge shaped or trough shape, with a reduction towards the lower narrow side 13, with an angled limitation towards the upper segments 14*e*, 14*g*, and with a larger width in the region ahead of the tips of the segments 14*f*, 14*d*; refer to FIG. 1.

The lower segment 14*c* is located in the region of the center of the lower narrow side 13, between the wedge-shaped broadened lower end of the lower left segment 14*d* and reduced lower end of the from the left upwardly extending diagonal segment 14*h*. The lower segment 14*c* evidences essentially the configuration of a shortened rectangle, almost a square, whose width is at least as large as those of the other segments in their widest areas.

Figures 2, 3:
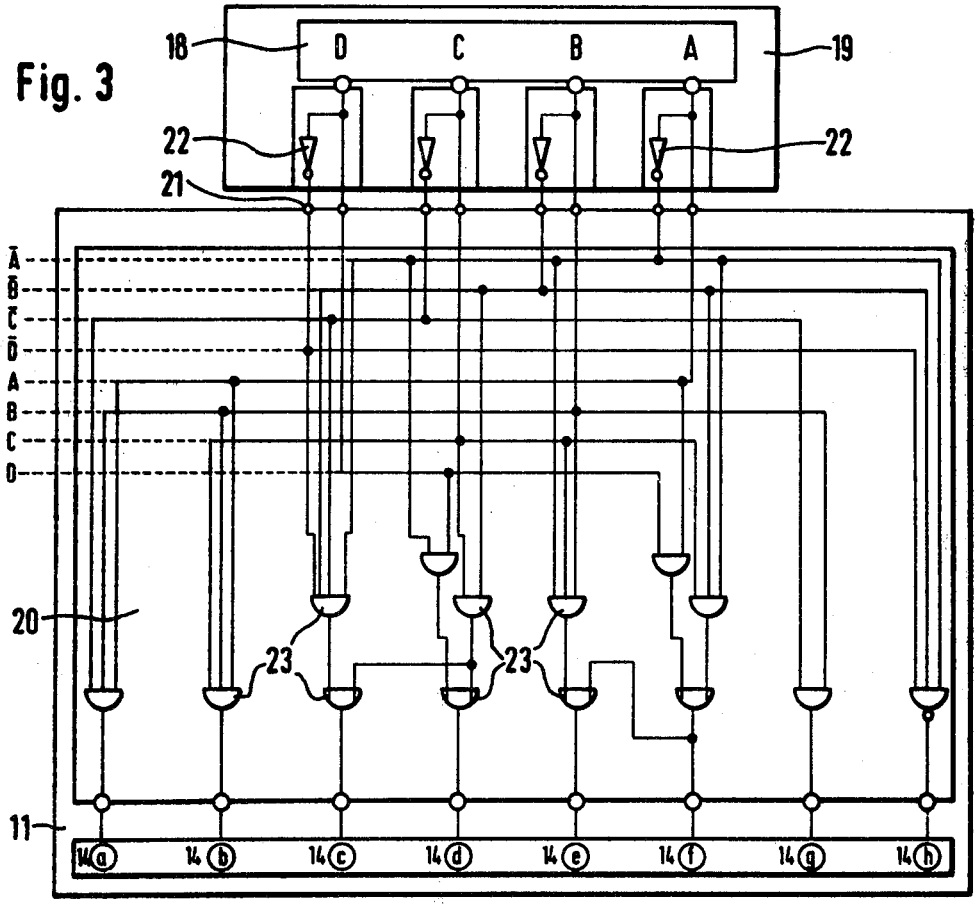
FIG. 2 illustrates the binary coding for these decimal numerical values and the therewith associated segments to be controlled in harmony with the oriental numerical representation in the left or in the right column in FIG. 1 in the form of a so-called formal logic tabulation for the segment control.
FIG. 3 is a gating circuit for the effectuation of the segment controls pursuant to the formal logic tubulation in FIG. 2.

For the individual decimal values 1, ——9,0 given in the center column of FIG. 2, there is obtained a segment control pursuant to the right entered and filled in (point-shaped) circles pursuant to the formal logic tabulation in FIG. 2, at the non-control of the segments 14 covered with open circles, the oriental numerical representation in the sequence of representation in the left and right column of FIG. 1.

For the individual decimal values pursuant to the center column in FIG. 2 there are indicated at the left adjacent thereto the four-position binary potential conditions of the BCD encoded output terminals 18 of a decimal transmitter 19 in the form, for example, of the output and driver stage of a calculating, counting or storage circuit, wherein O indicates the lower and L the high potential on the corresponding output terminal 18A, B, C, D; also other binary decimal latchings (a jump in the binary count sequence not first behind the value nine) can be present for the control of the numerical representation segments 14 of a display arrangement 11.

The segments 14 are connected through their electrodes (not shown in the drawing) to the outputs of a gate circuit 20, which includes the input terminals 21 for connection to the BCD output terminals 18 of the decimal transmitter 19. The gate circuit 20 is suitably united with the supporting structure for the arrangement of the segments 14 to a display device 11 in the form of a display module as can be recognized in FIG. 3 through the common border. In order to be able to operate with the fewest possible gating functions within the gate circuit 20 for effectuating the through-switching sequences in accordance with the measure of the formal logic tabulation (right part of FIG. 2) it is purposeful to not only address the direct outputs of the BCD output terminals 18A, - - - 18D, but also the inverted (complementary) output conditions. In the event that they are not immediately available at the output side of the decimal transmitter 19, an inverter 22 is to be connected to each BCD output terminal 18, which in distinction from the basic representation in FIG. 3, can also be positioned within the gate circuit 20 itself. The individual gate switching circuits 23, at a suitable substrate, can be constructed as a base for the retention and the electrical connection of the segments 14 directly on the back of this substrate in an integrated technology; similarly, if required, the inverters 22 are positioned so as to hold the negative potential conditions in readiness for the potential conditions of the BCD output terminals 18, which are entered in the left of FIG. 3 for clarification.

The individual gate switching circuits 23 of the gate circuit 20 are so designed and supplied at the input side with the direct and, occasionally, with the inverted BCD outputs signals, as well as switching at the output side to the respective control electrode of the segments 14, so that the segment control in accordance with the measure of the formal logic tabulation is obtained at the right in FIG. 2, for example, the diagonal segment 14*h* only for numerical representations of the value four and not zero, in contrast therewith the upper right segment 14*a* is optically activated only in the case of an oriental numerical representation of the value three (currently together with further segments 14 in accordance with the measure of the formal logic tabulation). For the formal logic tabulation in FIG. 2 (right) there is inserted in FIG. 3 a combination of gate switching circuits 23 within the gate circuit 20, in which there is considered for limitation of the technical circuit requirement that at the controlling of the segment 14*f* there is also to be constantly activated the segment 14*e* (values 4 and 9), namely, through OR-connection of the segment 14*e* also proceeding from the control of the segment 14*f*.

The combination of the gate switching circuits 23 illustrated in FIG. 3 fulfills the criteria of the formal logic tabulation pursuant to FIG. 2 (right). Within the scope of the invention the same logic conditions can, however, be also fulfilled through other gate constructions of the gate circuit 20, in particular when due to technological reasons, the gate circuit 20 is to be exclusively effectuated from NAND gates and, naturally, also when another BCD combination is prescribed for the decimal values.

What is claimed is:

1. In a numerical display arrangement having at least one display device for the selective representation of oriental numerals of the values zero through nine, said display device including individual, discretely controllable electro-optical display segments grouped within a parallelogram-like frame standing on the narrower side thereof, the improvement comprising: said display device including eight segments of which there are arranged along the upper narrow side of said frame, as viewed in a direction towards said display arrangements, two elongate segments adjacent each other and a point-shaped segment; therebelow, along the left lengthier frame side, two elongate segments located below each other; along the right lengthier frame side an elongate segment; a tied-in short segment between said segments extending along the lower narrow frame side; and an elongate diagonal segment in the center region of said frame extending from approximately the lower right frame corner upwardly towards the left.

2. Numerical display arrangement as claimed in claim 1, said upper left segment extending bent into an L-shape, said lower left segment downwardly extending from the free arm end of said upper left segment projecting towards the frame interior and offset with respect to the left lengthier frame side towards the frame center, said diagonal segment terminating in the region intermediate the transition between the two upper elongate segments and between the transition between the two left segments.

3. Numerical display arrangement as claimed in claim 2, said left lower segment widening wedge-shaped downwardly and said diagonal segment widening wedge-shaped upwardly, the lower narrowed end of said diagonal segment being located between the large-surfaced point-shaped lower segment and the lower end of the right segment, and which is offset along the lower narrow frame side in the direction towards the center thereof, with acute-angled positioning of the right segment opposite the right lengthier frame side.

4. Numerical display arrangement as claimed in claim 2, said point-shaped upper right segment being bounded with an extensive curvature, the upper left segment with quarter-circle like curvatures, and the center upper segment with a sicle-shaped low curvature, with sicle tips extending towards the right end upwardly.

5. Numerical display arrangement as claimed in claim 1, wherein each display device is operatively connected with a gate circuit having input terminals for connection to binary-encoded decimal-valued output terminals of a decimal transmitter.

6. Numerical display arrangement as claimed in claim 5, said gate circuit comprising gate switching circuits for the segment controls corresponding to predetermined decimal numerical values.

* * * * *